United States Patent [19]

Feuerman

[11] Patent Number: 4,667,860

[45] Date of Patent: May 26, 1987

[54] SEWING NEEDLE WITH EASY-THREADING FILAMENT LOOP

[75] Inventor: Arnold I. Feuerman, West Bloomfield, Mich.

[73] Assignee: Feuerman Research & Development Corporation, West Bloomfield, Mich.

[21] Appl. No.: 723,291

[22] Filed: Apr. 15, 1985

Related U.S. Application Data

[63] Continuation-in-part of Ser. No. 662,363, Oct. 15, 1984, abandoned, which is a continuation-in-part of Ser. No. 652,199, Sep. 20, 1984, abandoned, which is a continuation-in-part of Ser. No. 577,004, Feb. 6, 1984, abandoned, which is a continuation-in-part of Ser. No. 557,584, Nov. 14, 1983, abandoned.

[51] Int. Cl.[4] ..... D05B 87/00

[52] U.S. Cl. ..... 223/99; 223/102

[58] Field of Search ..... 223/99, 102

[56] References Cited

U.S. PATENT DOCUMENTS

| | | | |
|---|---|---|---|
| 299,305 | 5/1884 | Weed | 223/102 X |
| 383,733 | 5/1888 | Jenkins | 223/102 X |
| 1,293,660 | 2/1919 | Armstrong | 223/102 |
| 2,758,648 | 8/1956 | Dodds | 223/102 X |
| 2,786,619 | 3/1957 | Marion | 223/102 |
| 3,394,704 | 7/1968 | Dery | 223/102 X |
| 4,182,341 | 1/1980 | Perri | 223/102 X |

FOREIGN PATENT DOCUMENTS

| | | | |
|---|---|---|---|
| 142411 | 11/1930 | Fed. Rep. of Germany . | |
| 386973 | 12/1954 | Fed. Rep. of Germany . | |
| 505345 | 12/1954 | Italy | 223/99 |
| 184411 | 8/1922 | United Kingdom . | |

*Primary Examiner*—Werner H. Schroeder
*Assistant Examiner*—J. L. Olds
*Attorney, Agent, or Firm*—Krass & Young

[57] ABSTRACT

A sewing needle has a closed loop of a resilient filament secured to its rear end. In unstressed condition the filament has an open configuration allowing a sewing thread to be easily passed through it. As the needle is pulled through fabric the loop collapses under the forces imposed on its sides by the fabric.

2 Claims, 26 Drawing Figures

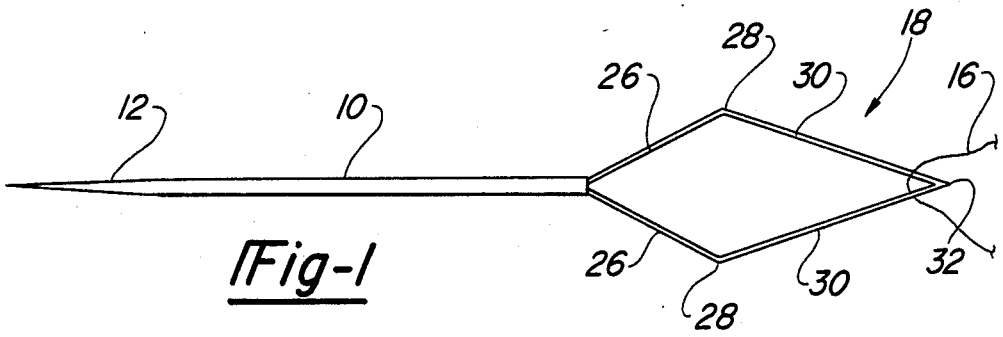
Fig-1
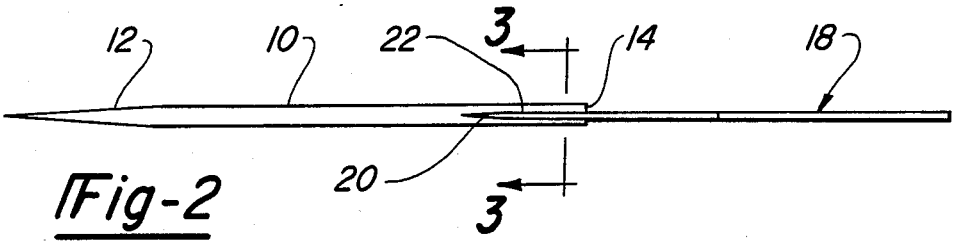
Fig-2
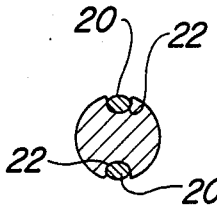
Fig-3
Fig-4
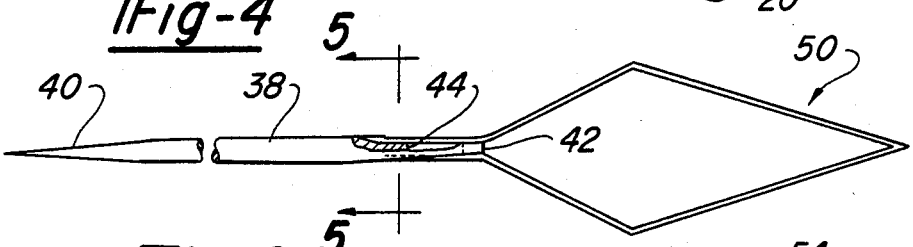
Fig-6
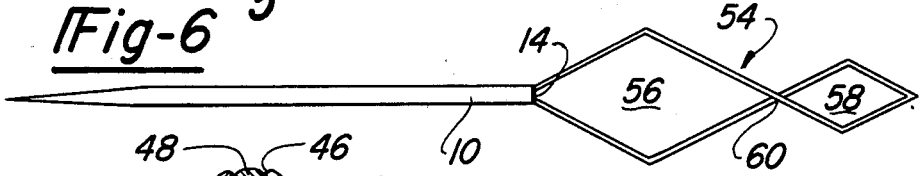
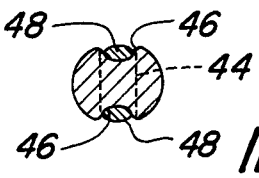
Fig-5

SEWING NEEDLE WITH EASY-THREADING FILAMENT LOOP

CROSS-REFERENCE TO RELATED APPLICATION

This application is a continuation in part of U.S. patent application Ser. No. 662,363, filed Oct. 15, 1984, entitled "Sewing Needle with Threading Attachment," now abandoned, which is a continuation in part of U.S. patent application No. 652,199 filed Sept. 20, 1984, now abandoned, which is a continuation in part of U.S. patent application No. 577,004, filed Feb. 6, 1984, now abandoned, which is a continuation in part of U.S. patent application No. 557,584, filed Nov. 14, 1983, now abandoned.

FIELD OF THE INVENTION

This invention relates to a sewing needle having a filament loop at its trailing end so that the needle may be easily threaded.

BACKGROUND OF THE INVENTION

Because of the well known difficulty of threading conventional manual sewing needles having narrow eyes formed at their trailing ends, a form of needle has been proposed incorporating a closed loop of a thin filament secured to the rear end of the needle. Thread to be used with the needle may be easily passed through the loop, which is substantially larger than the needle eye, and in use the loop is pulled through the fabric, behind the needle, carrying the thread through the fabric.

One form of such needle is disclosed in U.S. Pat. No. 1,293,660. The loops disclosed in this patent are secured to the needles by passing them through a conventional eye formed on the rear of the needle body.

Another form of looped needle, disclosed in U.S. Pat. No. 4,182,341, is intended primarily for surgical purposes. The needle body is formed with a truncated end having a central, dead-ended cavity opening on the end. The free ends of the filament forming the loop are secured within this cavity and the loop projects from the rear of the cavity. This arrangement necessitates that the needle body have a thickness many times the diameter of the filament and can only be employed with very thick needles or with filaments that are so thin as to be practically invisible.

The deficiencies of these previous designs for needles with following loops have apparently prevented such needles from making any substantial market penetration against conventional needles, despite the obvious advantages of the looped needle.

SUMMARY OF THE INVENTION

The present invention is accordingly directed toward a loop needle of a unique design which preserves the advantages of looped needles while overcoming the deficiencies of the prior art.

A preferred embodiment of the present invention, which will be subsequently disclosed in detail, utilizes a loop formed of a filament of thin spring steel wire, a plastic, or a similar material which is readily deformable under slight pressures but is highly resilient so as to immediately return to its normal configuration when the deforming forces are terminated and which will not assume any permanent deformation under the range of forces normally encountered in use. The filament is formed into a loop having a normal position, without the imposition of any external forces, lying in a single plane. The loop preferably has a general diamond shape with two acute angles at opposed ends and two obtuse angles intermediate these ends. The loop is secured to the trailing end of the needle body at one of the acute angles so that the loop lies in a plane including the axis of the needle and, in the absence of any deforming forces, the free acute angle of the loop projects away from the needle body.

In the preferred embodiment, the needle body and loop are formed from a single piece of material. This may be accomplished, for example, by fabricating the needle body, such as by injection or compression molding, and loop from a plastic having the desired properties of hardness and resilience. This one-piece may then be coated or "flashed" with chrome or other metallic coating, if desired.

In a second embodiment of the present invention, the trailing end of the needle body is preferably formed with a pair of concave depressions extending axially on diametrically opposed sides of the body. These depressions may be connected by a slit forming an eye in the manner of most conventional loopless needles or alternatively, the trailing end of the needle may be formed without an eye with just a pair of depressions on diametrically opposed sides. In attaching the filament to the needle the free ends of the filament lengths are laid in the two depressions and are secured to the needle body, preferably by crimping or swaging the sides over the filament ends so that the loop projects behind the needle.

In an alternative embodiment, the trailing end of the needle body is formed with a single concave depression extending axially along one side of the body. In this embodiment, each of the free ends of the filament are laid in the concave depression and are secured therein in the manner described above.

In another embodiment, the end face of the needle body is provided with a slot which runs across the diameter of the needle body. The filament is attached by inserting each of the free ends into the slot and crimping or swaging the end portion of the needle body surrounding the slot to secure the filament ends therebetween.

In yet another embodiment, the needle body is formed from a hollow tube, such as hypodermic tubing. Each of the free ends of the filament is inserted into one end of the tube and the tube is thereafter crimped or swaged at one or more points along its length to secure the ends therein. The end tube opposite the now installed filament is then formed by conventional metal working techniques into a satisfactory point.

In an alternative embodiment employing a hollow tube for the needle body, a pre-formed stylus having a relatively short shaft roughly equal in diameter to the inside diameter of the tube forming the needle body is forced into the open end of the tube opposite the end having the filament loop. The stylus is secured within the tubing by virtue of its tight fit due to the fact that its diameter is slightly larger than the inner diameter of the tubing or the insert may be secured within the tubing by crimping or swaging the tubing around the shaft of the stylus in a manner similar to that utilized to secure the filament ends therein.

The loop of the needle accordingly presents a wide target for attachment of the thread because of its normal diamond shaped configuration. The acute angle at the following end of the loop engages the thread to prevent the thread from slipping allowing single thread sewing. Because of the rigid position of the loop relative to the needle body, no difficulty is encountered in positioning the eye for threading. The loop material may be distinctively colored, by anodizing or the like, to increase the visibility of the loop and different size needles and may be provided with loops of different colors to assist in distinguishing one size from another.

In an alternative embodiment of the invention, the filaments that form the sides of the loop cross over one another near the trailing end of the loop to form a secondary closed loop. Thread for use with the needle is passed through the primary loop and when pulled away from the point of the needle falls into the secondary loop, which closes about the thread during sewing, to firmly lock the thread in place.

In yet another embodiment of the present invention, an open loop of spring steel wire shaped generally in the form of a diamond as described above, is provided for attachment to conventional sewing needles. In its normal unstressed configuration, the open ends of the filament abut each other, forming one of the acute angles of the diamond. This attachment is secured to an existing conventional sewing needle by inserting the free ends of the filament into the needle eye and securing the abutting ends to each other and, preferably, to a portion of the inner surface of the needle eye by spot welding or with a dry adhesive.

BRIEF DESCRIPTION OF THE DRAWINGS

Other objectives, advantages and applications of the present invention will be made apparent by the following detailed description of preferred and alternative embodiments of the invention. The description makes reference to the accompanying drawings in which:

FIG. 1 is a plan view of a first embodiment of a looped needle formed in accordance with the present invention;

FIG. 2 is a side view of the needle of FIG. 1;

FIG. 3 is a sectional view through the needle of FIG. 1 taken along lines 3—3 of FIG. 2;

FIG. 4 is a plan view of an alternative embodiment of the invention constructed about a needle having a conventional eye;

FIG. 5 is a sectional view of the needle of FIG. 4 taken along lines 5—5 of FIG. 4;

FIG. 6 is partial sectional view through an alternative embodiment of the invention having a double looped trailing filament;

DETAILED DESCRIPTION OF THE INVENTION

Figure 17:
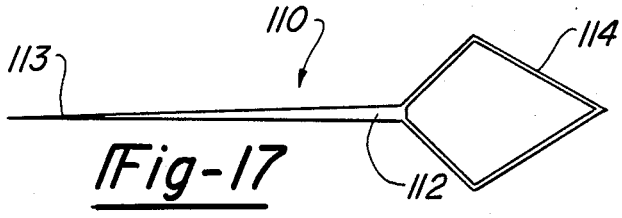
FIG. 17 is a perspective view of a single-piece embodiment of the easy-threading needle of the present invention formed from injection molded plastic.

In a preferred embodiment of the present invention, illustrated in FIGS. 17 and 18A–C, an easy-threading needle 110 comprising a thin elongate needle body 112 with a point 113 at one end and a thread-receiving section, formed as a closed loop 114 extending from the opposite end. In the preferred embodiment, the needle body 112 and loop 114 are formed from a single piece of material, such as plastic or spring steel. The needle body 112 and loop 114 may be formed from a single piece of plastic, as shown in FIG. 17, using conventional injection and/or compression molding techniques. The needle 110 may then be coated, such as by flashing with chrome or other metallic coating, to achieve the desired appearance.

Figure 18A:
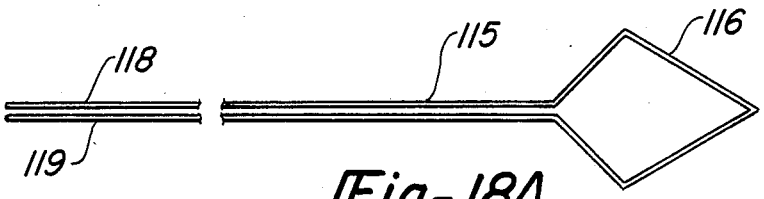
FIGS. 18A–C illustrate the progressive steps in a method for manufacturing a single-piece needle from metal filament in accordance with the present invention.
Figure 18B:
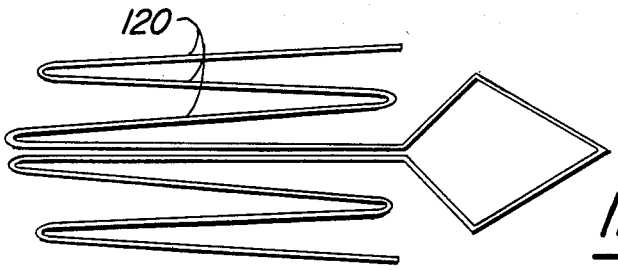
Figure 18C:
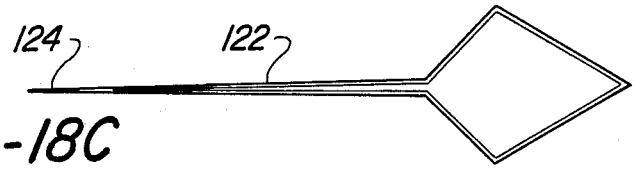

Referring to FIGS. 18A–C, the easy-threading needle of the present invention may be manufactured from a single filament 115 of suitably resilient metal, such as spring steel, by first forming the loop portion 116 (FIG. 18A), folding the remaining lengths of the free ends 118–119 of the filament into a stacked series of segments 120 of a length corresponding to the desired length of the needle body (FIG. 18B). This stack of wire segments 120 is then formed by conventional metal working techniques, such as cold working, into a thin elongate needle body 122 (FIG. 18C). The needle body 122 may then be provided with a point 124 and the desired finished surface by employing known metal finishing techniques.

It will be appreciated by those skilled in the art that, by constructing the needle body and loop as a single unitary member, as shown in FIGS. 17 and 18A–C provides an easy threading needle with a securely affixed loop without many of the manufacturing problems and costs associated with similar prior art devices. It should be noted that the filament loop may be provided with a configuration other than the preferred diamond shape illustrated in the figures without departing from the spirit of the invention.

Referring to another preferred embodiment of the invention illustrated in FIGS. 1–3, a stainless steel needle body 10, of appropriate diameter and length for hand sewing, has a forward pointed end 12. The rear end of the needle is truncated at 14 and does not incorporate the eye found in conventional needles. A thread 16 to be used with the needle is attached to the needle by passing it through a trailing filament loop, generally indicated at 18.

The loop 18 is formed of a filament which is small in diameter in comparison to the needle body 10 preferably having a diameter no greater than one-third of that of the needle body 10. The filament is preferably metal wire such as spring steel. The wire is resilient and readily deformable.

The wire filament 18 has a pair of free ends 20 which are secured to the trailing end of the needle body 10 by virtue of being crimped, as by a swaging operation, within concave depressions 22 formed axially along the needle body for some distance from its trailing truncated end 14, and opening onto the truncated end. Alternatively, the filament could be welded, soldered or otherwise secured within the depression 22. The concave depressions have a diameter preferably less than about 20% of the diameter of the needle body, so that they do not substantially weaken the needle body.

Figure 7:
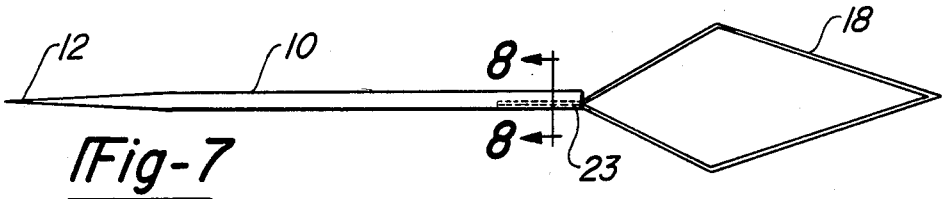
FIG. 7 is a plan view of an alternate embodiment of a looped needle formed in accordance with the present invention.
Figure 8:
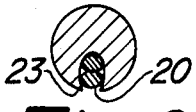
FIG. 8 is a sectional view through the needle of FIG. 7 taken along lines 8—8 of FIG. 7.

Referring to FIGS. 7 and 8, an alternate embodiment of the present invention employs a single concave depression 23 formed axially along one side of the needle body 10 for some distance from its trailing truncated end and opening onto the truncated end. A wire filament 18 is secured to the needle body 10 by inserting each of the filament ends 20 within the single concave depression 23 and crimping or swaging the filament ends 20 within the depression 23 in the manner described above.

Figure 20A:
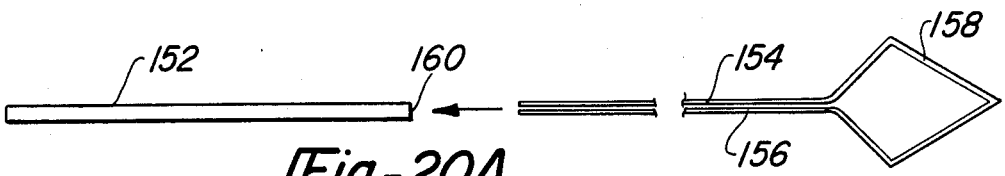
FIGS. 20A–C illustrates an embodiment of the present invention employing a piece of tubing for the needle body and the progressive steps in the method for manufacturing same.
Figure 20B:
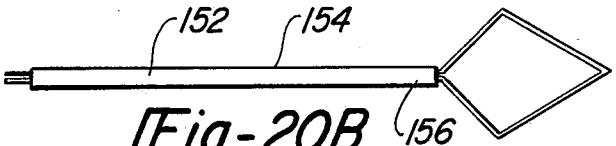
Figure 20C:
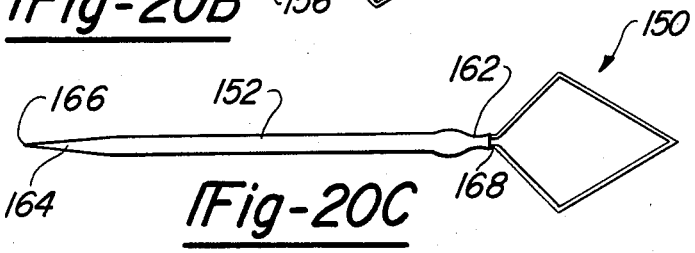

Referring to FIGS. 20A–C, another embodiment of the present invention 150 employs a length of hollow tubing, preferably made from stainless steel, as the needle body 152. Commercially available hypodermic tubing, having an outside diameter equal to the desired finished diameter of the needle and an inside diameter large enough to accommodate each of the free ends 154–156 of the filament, is preferably utilized for this purpose. The needle 150 may be constructed by forming the filament 158 into its desired configuration, inserting the free ends 154–156 of the filament into the opening 160 at one end of the tubing 152 (as shown in FIG. 20B), and crimping and/or swaging the tube at one or more locations 162–164 along its length, thereby securing the filament 158 within the tube 152. As an alternative, the filament ends may be secured within the tube, or within concave depressions formed on the outer surface of the tube with a dry adhesive, solder, or other adhesion means discussed hereinafter. The point 166 is then formed on the opposite end of the tube by swaging or other conventional metal working techniques. It should be noted that the surface of the needle body in the area where crimping or swaging operations have been performed such as at 162 should be worked to a relatively smooth finish to ensure that the needle will pass smoothly through the material. The needle body 152 may be formed with a cross section at 168 slightly larger than the widest cross section of the needle at the filament end 160 to ensure that material does not catch in the area 162 where the needle body has been crimped.

Figure 21A:
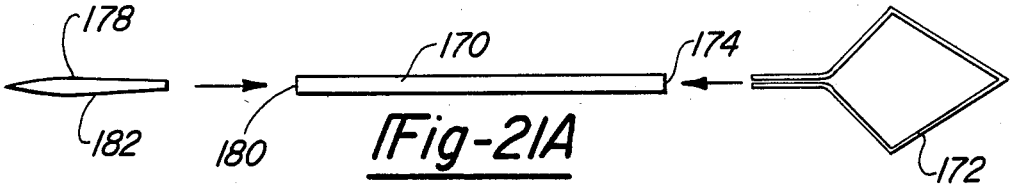
FIGS. 21A–B illustrate an embodiment of the present invention which employs a piece of tubing for the needle body and a sharpened solid insert for the needle point end.
Figure 21B:
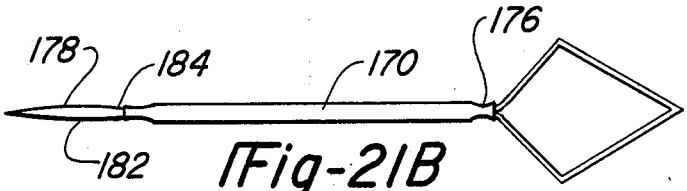

An alternative embodiment of a needle of the present invention which utilizes tubing for the needle body is shown in FIGS. 21A–B. In this embodiment, a length of tubing, as described above, is utilized for the needle body 170. Similarly, a suitable wire or resilient plastic filament 172 is inserted into one end 174 of the needle body 170 and the needle body crimped or swaged at a selected point 176 or points, securing the filament therein. A sharp stylus 178 having a point at one end and a generally cylindrical cross section at the other end is inserted into the other end 180 of the tubing to form the completed needle. This insert is preferably made from stainless steel and is provided with a cross section at its blunt 182 that is roughly equal to or slightly larger than the inside diameter of the tube at its open end 180. The stylus 178 should fit relatively snuggly within the needle body 170. It should be noted that a "press fit" of the stylus 178 is normally an adequate means of securing the stylus 178 to the needle body 170, as the forces imposed upon the stylus 178 during normal use tend to urge the stylus 178 into the hollow needle body 170. However, the needle body 170 may be crimped or swaged, as in the manner described in connection with securing the filament 172 therein, in order to ensure a secure bond between the stylus 178 and the needle body 170. The stylus 178 should be widest in cross section at a point 182 that is immediately adjacent and forward of the tube end 180 after the stylus 178 is installed therein. This slightly wider cross section ensures that the point will smoothly move through the fabric without catching on the slightly flared end 184 of the tubing.

Figure 9:
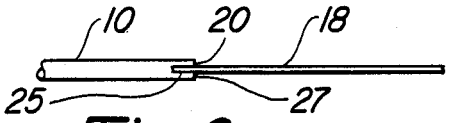
FIG. 9 is a side view of another alternative embodiment of a looped needle formed in accordance with the present invention.
Figure 10:
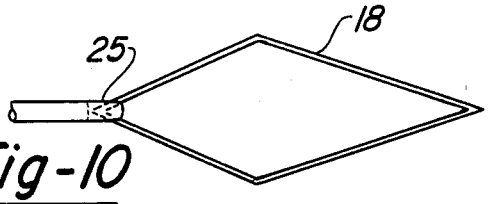
FIG. 10 is a top partial view of the needle of FIG. 9.

Another structure which provides for inexpensive and secure attachment of the filament to a needle body to form the device of the present invention is shown in FIGS. 9 and 10. In this embodiment, a slot 25 is located in the trailing end of the needle body 10. The slot runs generally parallel to the longitudinal axis of the needle body 10 and preferably runs across the diameter of the needle body 10 and opens at the end face 27 of the needle body. The filament 18 is secured to the needle body 10 by inserting each of the ends 20 into the slot 25 in the end face 27 and secured therein by any suitable securing means such as a conventional adhesive, welding, soldering, crimping or swaging the end portion of the needle body 10 surrounding the slot 25. A preferred method of securing the filament 18 to the needle body 10 is by soldering using silver solder.

Referring again to FIGS. 1–3, the loop 18 is formed with a generally diamond shape. The two free ends 20, in their unstressed condition, extend outwardly, away from one another, in the same plane, in sections 26, each of which preferably makes an acute angle with respect to the central axis of the needle. The sections 26 terminate in obtuse angles at bends 28 which define the limits of the widest separation of the loop. This separation between the bends 28 is preferably several times the diameter of the needle body, providing a wide target for easy threading.

The trailing end of the loop 18 is formed by a pair of filament sections 30 which exend from the obtuse angle bends 28 to an acute angle rear bend 32 where they join one another. The sides 30 of the loop preferably form a more acute angle relative to the central axis of the loop then do the sides 26, so that the end of the loop to the rear of the bends 28 is substantially longer than the section of the loop forward of the bends. This configuration assures that the loop sections 28 will be relatively stiff compared to the loop sections 30, maintaining the loop, which lies in a single plane, in an open configuration when unstressed. It also increases the acuity of the rear angle bend 32 so that that bend readily grips the thread 16. This grip allows a single needle threading which may be aided by passing the thread through the loop more than once.

This needle may thus be easily threaded, and maintains a positive grip on the sewing thread yet the loop configuration easily deforms into a collapsed condition under the forces imposed on it by the sides of the fabric being sewn when the needle is drawn through the fabric. The concave depressions 22 formed in the needle body do not appreciably weaken it.

The needle body 10 must be specially formed, unlike the needle 38 which is used in the embodiment illustrated in FIGS. 4 and 5, and consists of a conventional needle, having a pointed end 40 and a trailing end 42 formed with a conventional eye 44 with a pair of concave depressions 46 formed on opposite sides of the eye. The free ends 48 of a filament loop, generally indicated at 50, are swaged within these depressions. As will be appreciated by those skilled in the art, the free ends 48 of the filament loop 50 may also be secured to the conventional needle by applying sufficient heat to the end portion of the needle body 38 near the eye 44 in order to increase its malleability, inserting the free ends 48 of the filament loop into or through the eye 44, and then collapsing the needle body 38 surrounding the eye by using mechanical pressure or otherwise securing the filament ends therebetween. The loop 50 lies in a single plane and preferably has the same diamond-like configuration as the loop 18 used with the embodiment of FIGS. 1–3.

Those skilled in the art will appreciate that attachment techniques such as swaging or crimping or otherwise embedding the free ends 20,48 of a filament loop into a needle 10,38 are most effective when performed during the manufacture of the needle, before the needle body 10,38 has been hardened. It should be noted that any of the above-described embodiments shown in FIGS. 1–10 can be utilized to produce a finished product using a relatively malleable needle body. However, when a filament loop 18 is being secured to a conventional sewing needle 38 or a needle body 10 that has already undergone some hardening, the portion of the needle body to which the ends of the filament loop are being attached should be exposed to sufficient heat to increase the malleability of the needle body before any crimping or swaging operation. As an alternative, adhesion means, such as a dry adhesive, welding or soldering may be utilized to affix the filament ends 20 to an already hardened needle body 38.

Figure 19:
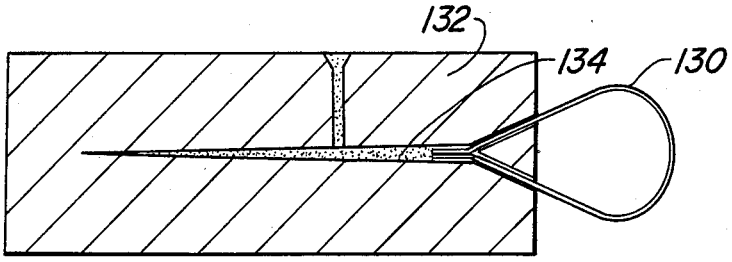
FIG. 19 illustrates the method of injection molding a needle body in a mold into which a filament has been inserted prior to injecting the needle body material.

It should be noted that a separate plastic or spring metal filament loop 130 of the above-described configuration may be inserted into a mold 132, such as a plastic injection mold, as illustrated in FIG. 19. The needle body is subsequently injection molded from plastic or other suitable material. In this manner, the molten plastic forming the end of the needle body will fill the cavities 134 in the mold and surround the inserted portion of the filament loop, thereby securing the loop to the molded plastic needle body.

FIG. 6 illustrates another embodiment of the invention, constructed about a truncated needle body 10 of the same type employed with FIG. 1. In this embodiment, the filament loop, generally indicated at 54, is formed with a primary loop section 56 and a trailing secondary loop section 58 of somewhat smaller size than the section 56, formed by the sides of the loop crossing over one another at 60. A section of thread may be passed through the larger loop section 56 and then drawn back into the secondary loop 58. When the needle is drawn through fabric, the secondary loop 58 closes about the thread securely locking it in place.

Those skilled in the art will appreciate that single thread sewing can be effectively accomplished with the diamond loops 18, 50 and 54 illustrated and described above. One end of the thread can be looped around the filament a number of times and will be locked into place between the collapsing sides of the filament nearest the acute angle at the trailing end of the filament 18, 50 or 54. After sewing, the thread can be easily removed by sliding the windings of thread up one side of the filament 18, 50 or 54 away from the acute angle end. As the windings are slid up the side of the filament, they tend to separate and unravel, facilitating their easy removal.

Figure 11:
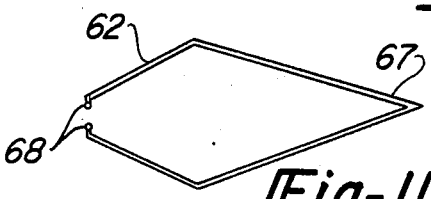
FIG. 11 is a plan view of an attachment clip formed in accordance with the present invention.
Figure 12:
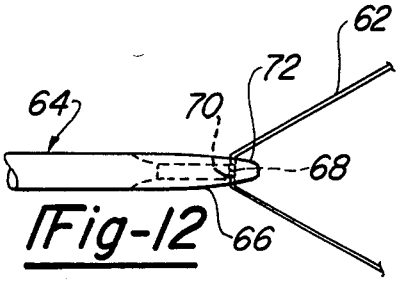
FIG. 12 is a partial view of the clip of FIG. 11 installed on a conventional sewing needle.

Referring to FIGS. 11 and 12, another embodiment of the present invention, in the form of a resilient metallic diamond-shaped open filament loop 62 is provided for a quick attachment to conventional sewing needles. In its normal relaxed condition, the open ends 68 abut each other forming an acute angle at one end of the diamond-shaped loop 62. The clip may be attached to a conventional needle 64 by inserting the abutting ends 68 into the eye 66 of the needle 64 and adhesively or otherwise securing the abutting ends 68 to each other. The clip 62 may then be adhesively secured within the eye 66 of the needle 64, preferably along the inner end face 70 of the eye 66. The loop may also be adhesively secured to the depressions 72 formed on opposite sides of the eye to attain a more secure attachment. It should be noted that the clip 62 can be formed as an open loop with the ends nearest the acute angle at the trailing end 67 of the loop 62 initially unattached. After insertion of the loop 62 through the eye of a conventional needle 64, the trailing ends may then be secured to form the acute by butt welding or spot welding.

It should also be noted that an open loop of resilient material, such as nylon or spring steel, can be passed through the eye 66 of a conventional needle 64, and the free ends of the loop secured by spot welding or butt welding to form an O-shaped filament without departing from the spirit of Applicant's invention.

Figure 13:
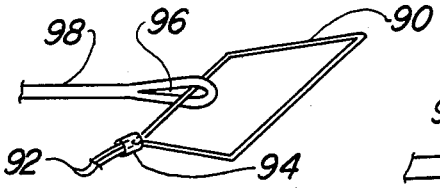
FIG. 13 is a partial perspective view of an attachment clip being installed on a conventional sewing needle.
Figure 14:
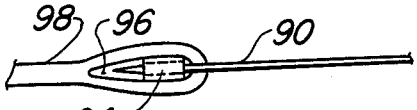
FIG. 14 is a partial side view of the clip of FIG. 13 installed on a conventional sewing needle.

Referring to FIGS. 13 and 14, another method of securing an open filament loop 90 is accomplished by inserting the free ends 92 of the loop into a tube 94, such as a hypodermic tube, which has an inner diameter sufficiently large to receive each of the free ends 92. The outer diameter of the tube 94 should be slightly smaller than the eye 96 of a conventional needle 98. After the ends 92 of the filament are inserted into the tube 94, the tube 94 may then be lodged within the eye 96 of the needle 98.

Figure 15:
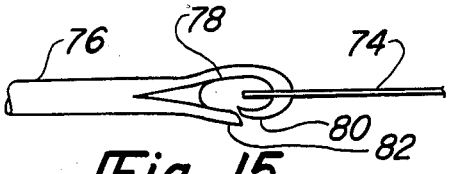
FIG. 15 is a side view of another embodiment of a looped needle formed in accordance with the present invention.
Figure 16:
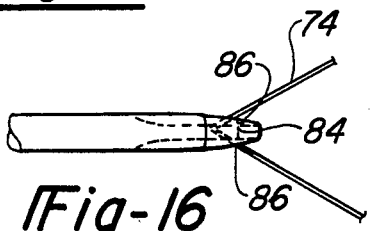
FIG. 16 is a bottom view of the needle of FIG. 13.

As shown in FIGS. 15 and 16, a conventional needle 76 may be modified to quickly and easily receive a closed loop filament 74 of the present invention by cutting or otherwise removing a portion of the needle body on one side thereof to create an opening into the eye 78 of the needle. It should be noted that after this opening is created, the upper portion 80 of the needle surrounding the opening should be bent, filed or otherwise formed so that its end is closer to the central longitudinal axis of the needle than the opposing end 82 of the needle surrounding the opening to ensure that the first end 80 does not catch on fabric as the needle 76 is being pulled therethrough. The filament 74 is preferably attached to the needle body 76 by inserting the filament into the now open eye 78 of the needle and adhesively securing the filament to the contacting surface 84 within the eye 78 of the needle 76. Again, a more secure attachment can be formed by applying adhesive to the portions of the filament loop 74 which contact the concave depressions 86 formed on opposite sides of the eye.

A resilient O-ring (not shown), preferably made from nylon or spring steel, can be inserted into the opened eye portion 78 of the needle body 76 depicted in FIG. 13 and either secured within the eye as described above or allowed to freely move within the eye and provide an easy-to-attach resilient filament in keeping with the spirit of Applicant's invention.

It should be noted that, while the present invention has been described in connection with its use as a conventional hand sewing needle, the easy threading features of the present invention are equally advantageous in other sewing applications, such as with surgical needles or darning needles. The diamond shape of the filament provides for a quick and substantial flattening of the opposing sides of the loop under relatively low tension to ensure that the hole formed by the needle is not enlarged by the filament.

I claim:

1. A sewing needle assembly comprising:

(A) an elongated rigid needle having a point at one end;

(B) a filament formed into a substantially diamond shaped loop having a pair of obtuse angles at opposite sides of the loop and acute angles at opposite ends of the loop;

(C) said loop being secured at one of its end to the other end of said needle in such a manner as to rigidly maintain said loop in trailing fashion to said needle in a single common plane with the lengthwise axis of said needle;

(D) said filament having a cross-sectional diameter substantially less than the cross-sectional diameter of said needle;

(E) said filament loop having a separation at said obtuse angles several times the cross-sectional diameter of said needle;

(F) said filament being resilient so as to allow it to collapse and pass through fabric being sewn following passage of said needle through the fabric without distortion of the fabric beyond that imposed by the needle and expand to reassume its unstressed configuration following its passage through the fabric;

(G) said loop having sufficient rigidity such that it remains in said single common plane with said needle axis as it collapses upon passage through the fabric and as it expands to its unstressed configuration following such passage;

(H) the sides of said loop adjacent said needle being shorter than the sides of said loop remote from said needle, whereby said adjacent sides are relatively more resistant to closure than said remote sides and the angle at the remote end is more acute than the angle at the adjacent end to thereby enhance the tendency of the remote end to clamp a thread.

2. A sewing needle assembly according to claim 1 wherein:

(I) said adjacent sides are substantially equal in length to each other and said remote sides are substantially equal in length to each other.

* * * * *